US006048193A

United States Patent [19]

Juntunen et al.

[11] Patent Number: 6,048,193

[45] Date of Patent: Apr. 11, 2000

[54] MODULATED BURNER COMBUSTION SYSTEM THAT PREVENTS THE USE OF NON-COMMISSIONED COMPONENTS AND VERIFIES PROPER OPERATION OF COMMISSIONED COMPONENTS

[75] Inventors: Robert Dean Juntunen, Minnetonka; Scott Paul O'Leary, Plymouth; Richard Mark Solosky, Minnetonka, all of Minn.

[73] Assignee: Honeywell Inc., Golden Valley, Minn.

[21] Appl. No.: 09/235,178

[22] Filed: Jan. 22, 1999

[51] Int. Cl.[7] ..... F23N 5/24

[52] U.S. Cl. ..... 431/6; 431/15; 431/18; 126/116 A; 702/113

[58] Field of Search ..... 431/2, 6, 13, 14, 431/15, 16, 17, 18, 154; 702/113; 126/116 A

[56] References Cited

U.S. PATENT DOCUMENTS

| | | | |
|---|---|---|---|
| 4,644,266 | 2/1987 | Reuter | 431/13 |
| 4,835,670 | 5/1989 | Adams et al. | 431/18 |
| 4,880,376 | 11/1989 | Bartels et al. | 431/17 |
| 5,055,825 | 10/1991 | Yang | 431/13 |
| 5,205,486 | 4/1993 | Jung | 431/14 |
| 5,865,611 | 2/1999 | Maiello | 431/2 |

FOREIGN PATENT DOCUMENTS 11-63484 3/1999 Japan .

OTHER PUBLICATIONS

"7700 Boiler Control System," by Honeywell, Inc., 1994, revised Jun. 1994 pp. 1 and 7.

*Primary Examiner*—Ira S. Lazarus
*Assistant Examiner*—Sara Clarke
*Attorney, Agent, or Firm*—Merchant & Gould P.C.; William W. Cochran, II

[57] ABSTRACT

A modulated burner combustion system that prevents the use of components that were originally not commissioned for use in the system. The present invention uses actuators that contain unique stored identification numbers. When the system is initially configured or commissioned, the unique identification numbers of the actuators are stored in non-volatile memory in a fuel/air controller. When the system is brought on line, the fuel/air controller microprocessor initially sends false IDs to the actuator together with test control signals to determine if the actuator operates in response to the false identification numbers. If the actuator does operate in response to the false identification numbers, that is an indication that the system has been tampered with and the system is, consequently, shut down. Subsequently, the true identification numbers are transmitted to the actuators with test control signals. The fuel/air controller microprocessor determines if the actuators move properly in response to the test control signals. If they do not move or do not move properly, that is an indication that an actuator is present in the system that was not originally commissioned with the system, or that an actuator is operating improperly. In that case, the system is also shut down. The feedback mechanism of the present invention eliminates the need for expensive safety software and expensive microprocessors in the actuators.

15 Claims, 5 Drawing Sheets

MODULATED BURNER COMBUSTION SYSTEM THAT PREVENTS THE USE OF NON-COMMISSIONED COMPONENTS AND VERIFIES PROPER OPERATION OF COMMISSIONED COMPONENTS

BACKGROUND OF THE INVENTION

A. Field of the Invention

The present invention pertains generally to life safety systems such as boilers, furnaces, hot water heaters, etc. and more specifically to the components for controlling these systems, such as actuators and controllers.

B. Background of the Invention

Combustion systems, such as a system that modulates the fuel/air ratio of large burner, require preventive measures that guard against alteration of the system. For example, fuel/air control systems are used on modulating burners that fire boilers to produce steam or hot water for process and/or heating applications.

Different types of combustion systems, and even combustion systems of the same genre, typically operate in the most efficient and safest manner with fuel/air profiles that are specifically configured for that particular system. In large commercial applications, it is not uncommon to have multiple and dissimilar combustion systems at the same location and possibly in near proximity. Various systems components, such as fuel/air controllers, or actuators, may fail over time. A common troubleshooting technique, especially in emergency situations, is to utilize or swap components from another system or obtain components from a service technician. The response characteristics of the actuators can vary greatly from component to component. For example, the initial starting position of a particular actuator may vary from model to model and its response characteristics to current control signals may be different. Similarly, different fuel/air controllers typically provide profiles that are completely different from the profile that was recorded during the initial setup (initial configuration or initial commissioning).

These problems may significantly affect the operation of the combustion system. For example, the swapping of a fuel/air controller may result in the use of a fuel/air controller that has an invalid light-off position. The curve programmed into the new fuel/air controller may introduce a fuel rich atmosphere into the combustion chamber which can become explosive or cause stack fires. Similarly, the fuel/air controller may not be designed to provide sufficient purge prior to lighting. Lean fuel conditions can also cause problems associated with the flame front leaving the burner head. This creates a region of unburned fuel which can re-ignite or flame out. Any of these situations can result in property loss, injury and even death.

The swapping of actuators can result in similar problems. This is because there is not any method to ensure that the replacement actuator is attached to the shaft at the same exact positional relationship as the actuator that was configured or commissioned with the combustion system. Moreover, the actual response of the actuator to current values may vary from the original actuators.

At least one previous method of preventing the replacement of a component has used expensive microswitches that are placed on the back of the component so that when the component is lifted from its subbase, the component is inactivated. Such systems require expensive batteries and battery monitoring circuits to ensure that they are operational. Further, such systems are not forgiving in cases of routine maintenance or initial troubleshooting due to wiring errors that require the component to be removed.

Hence, it is desirable to have a system in which replacement of either controllers or actuators cannot be accomplished without reconfiguring or recommissioning the controller with the appropriate combustion profile for the particular components involved.

SUMMARY OF THE INVENTION

The present invention overcomes the disadvantages and limitations of the prior art by providing system controls that prevent the swapping of system components that may affect the operation of a combustion system and, in addition, detect if such a swap has occurred to prevent the operation of the system. The present invention can also detect the proper operation of the commissioned components.

The present invention may therefore comprise a modulated burner combustion system comprising actuator components that have actuator identification numbers that identify the actuator components; position indicators coupled to the actuator components that indicate movement of the actuator components; a controller component that stores actuator identification numbers for actuator components that have been configured with the modulated burner combustion system to provide a predetermined fuel/air ratio profile for the modulated burner combustion system and transmits the actuator identification numbers stored in the controller component to the actuator components together with test control signals, and disables the modulated burner combustion system if the position indicators indicate that the actuator components have failed to move properly in response to the test control signals.

The present invention also provides a method of operating a modulated burner combustion system that includes a controller, at least one actuator, and at least one position indicator that have been configured to provide a predetermined fuel/air ratio profile for operating the modulated burner combustion system comprising the steps of transmitting an actuator identification numbers from the controller to the actuator with test control signals; detecting if the position indicator indicates movement of the actuator in response to the test control signals; preventing use of the modulated burner combustion system when movement is not detected by the position indicator following transmission of the test control signals and an actuator identification number that corresponds to an actuator in the modulated burner combustion system when the modulated burner combustion system was configured.

The advantages of the present invention are that it eliminates expensive prior devices for determining if originally commissioned components have been removed from the system. Further, the present invention does not require expensive power supply protection that would be required for commands transmitted via communication links, or more expensive processors and software necessary to implement such a system. The present invention provides a simple and inexpensive way to transmit commands between a low cost controller and low cost actuator in a safe and reliable fashion with the ability to detect if any of these components are not the same components that were in the combustion system when the combustion system was commissioned (or configured) and to verify that commissioned components are responding properly. The present invention also has the ability to check if the system has been altered to operate with replacement components.

DETAILED DESCRIPTION OF THE PREFERRED EMBODIMENT

Figure 1:
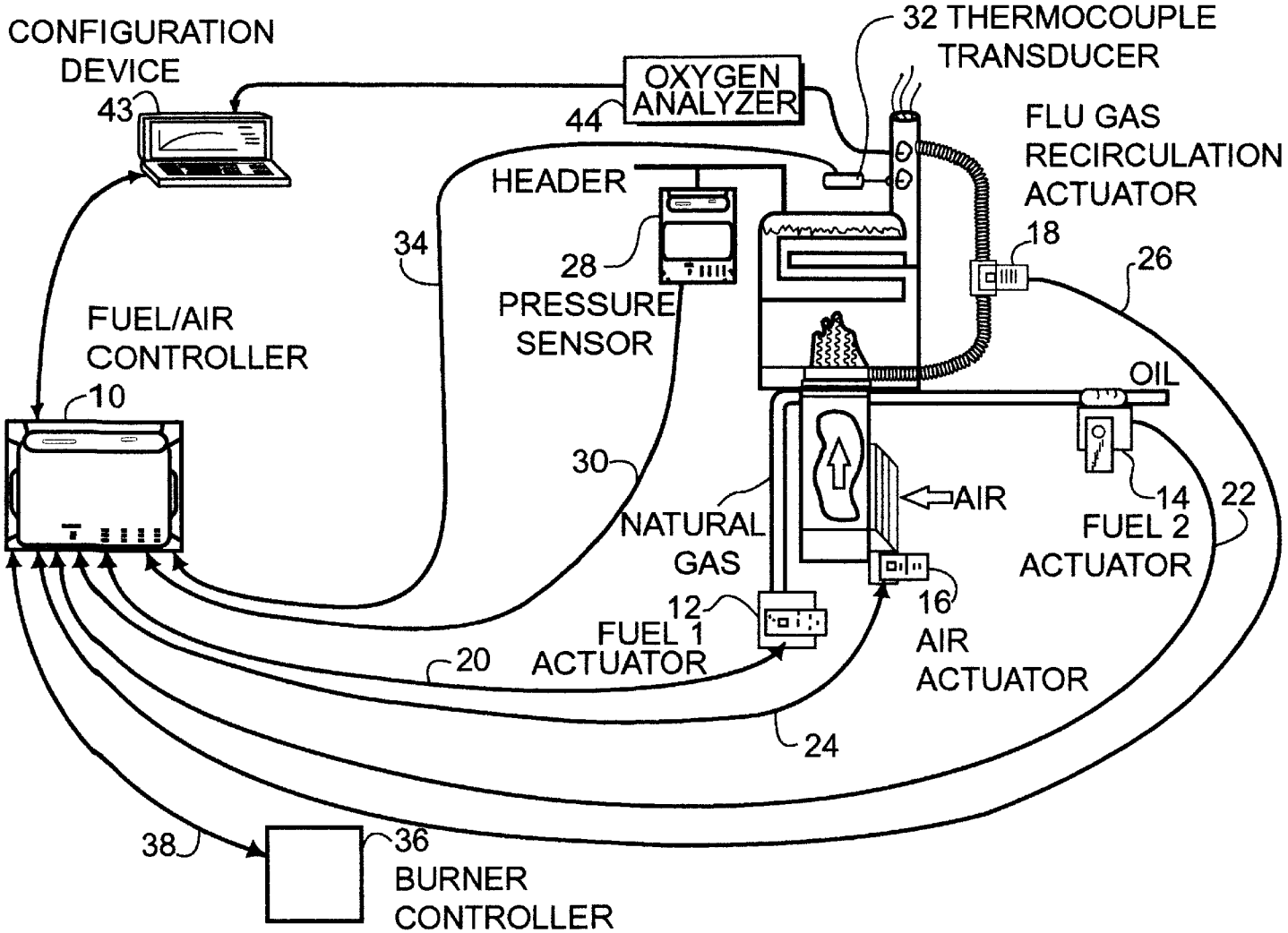
FIG. 1 is a schematic illustration that shows a typical modulated burner combustion system.

The fuel/air control system, illustrated in FIG. 1 consists of a fuel/air controller 10 and several actuators 2, 14, 16 and 18. The total number of actuators utilized in such a system is dependent upon the number of fuel sources available and whether a flue gas recirculation device is implemented in the system. Normally, the minimum number of actuators in such a system is two; one actuator to control fuel and another actuator to control air. The fuel/air controller 10, illustrated in FIG. 1, monitors and controls the actuators located on the boiler in response to a firing rate demand signal that is generated by a pressure sensor 28 and/or temperature transducer 32. For example, fuel/air controller 10 monitors and controls fuel 1 actuator 12 which controls the flow of natural gas to the burner, fuel 2 actuator 14 which controls the flow of oil into the burner, air actuator 16 which controls the amount of air provided to the combustion chamber and flue gas recirculation actuator 18 which controls the recombustion of flue gas in the combustion chamber, via control lines 20, 22, 24 and 26, respectively. Each of these control lines is coupled to both the fuel/air controller 10 and the actuators 12, 14, 16 and 18. Pressure information is provided from pressure sensor 28 to the fuel/air controller 10 via connector 30. Temperature information is provided from thermocouple transducer 32 to the fuel/air controller 10 via connector 34. Fuel/air controller 10 positions the actuators in preset positions in response to the firing rate demand, as provided on connectors 30 and 34 from the pressure sensor 28 and the thermocouple transducer 32, respectively. The burner controller 36 is also controlled by the fuel/air controller 10 via connector 38.

Figure 2:
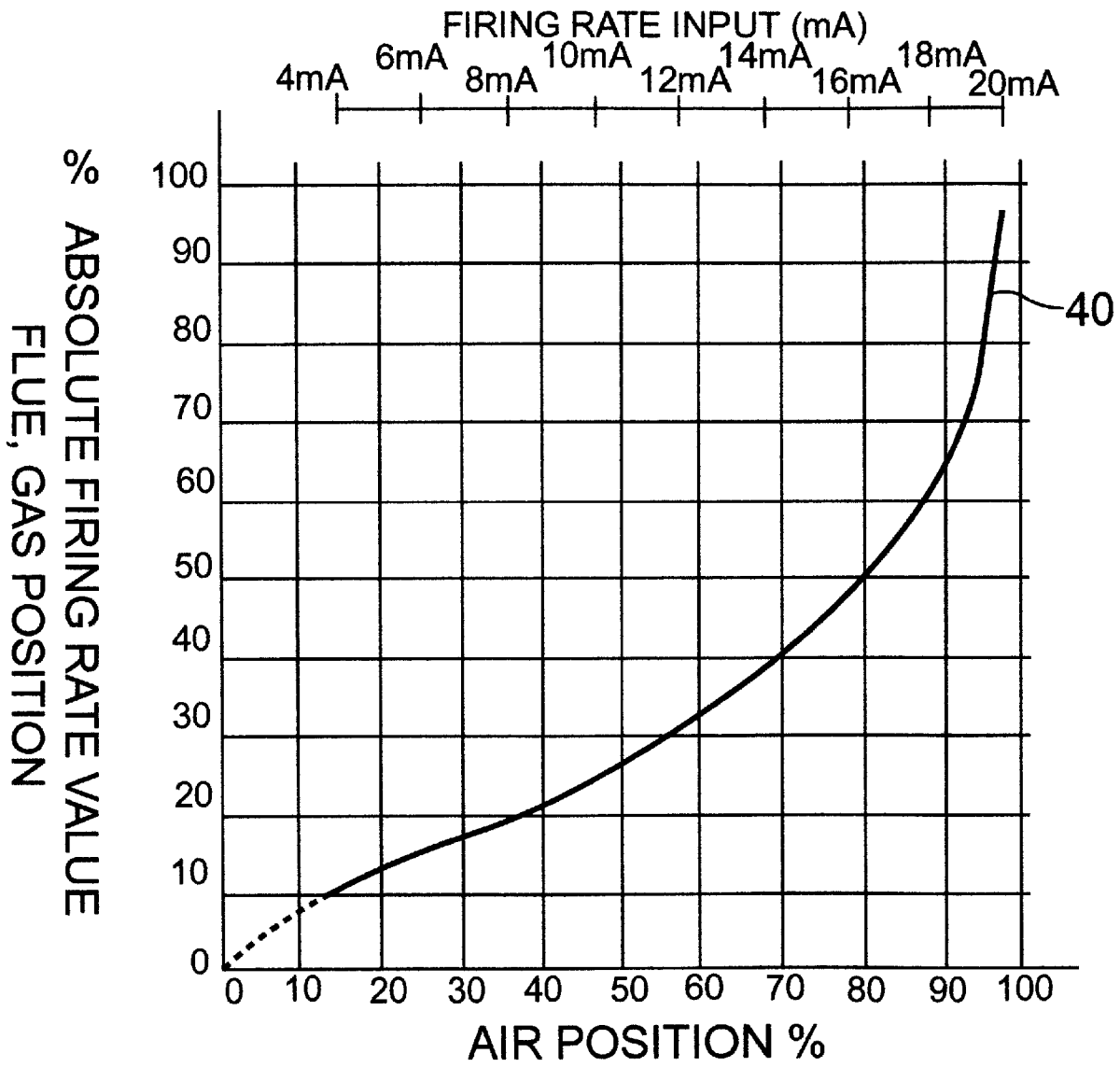
FIG. 2 is a graph that illustrates the percentage of the air position of an air actuator versus the percent of the absolute firing rate value. In addition, the firing rate input in milliamps is also plotted in FIG. 2.

FIG. 2 is a graph illustrating the percentage of air position of the air actuator versus the percentage of the absolute firing rate value. Additionally, the firing rate input provided from the pressure sensor 28 and thermocouple transducer 32 (FIG. 1) is also shown in FIG. 2. As can be seen from FIG. 2, the fuel/air profile, as illustrated by curve 40, is nonlinear. During initial commission of a system, such as illustrated in FIG. 1, expert service personnel utilize a configuration device, such as laptop personal computer configuration device 42 to monitor oxygen analyzer 44. Oxygen analyzer 44 functions as a combustion air analyzer for analyzing the oxygen content at various firing rate values. A plurality of firing rate input demands are provided via connectors 30 and 34 and the resultant position of the air actuator 16 is determined by the configuration device 42 in response to signals from the oxygen analyzer 44.

As shown in FIG. 2, the recorded air positions for the plurality of firing rate input demands are shown by a typical curve 40 in FIG. 2. The flue gas mixture at each point for the firing rate value is typically set to ensure stoichimetric combustion plus an excess margin of oxygen of from 5 percent to 10 percent. Other polluting constituents (NOX, NCO) are monitored and the levels of these constituents are also considered during setup or commission of the system. Once the entire profile has been determined, the configuration device 42 and the stack analyzer 44 are removed from the site. The system is then left to operate in an automatic fashion. The fuel/air controller 10 interfaces with the burner controller 36 via connector 38 which is responsible for flame safety monitoring as an independent controller. The burner controller 36 can force the fuel/air controller 10 into two preprogrammed positions. The first position is a prepurge position in which a number of air exchanges are provided in the combustion chamber via air actuator 16 prior to ignition of the burner. After the burner is lit and running, the burner controller 36 allows the fuel/air controller 10 to modulate each of the actuators 12, 14, 16, and 18 in accordance with the input demand signal provided by pressure sensor 28 and thermocouple transducer 32 and as a function of the profile for the particular system that is configured in accordance with curve 40 (FIG. 2).

Figure 3:
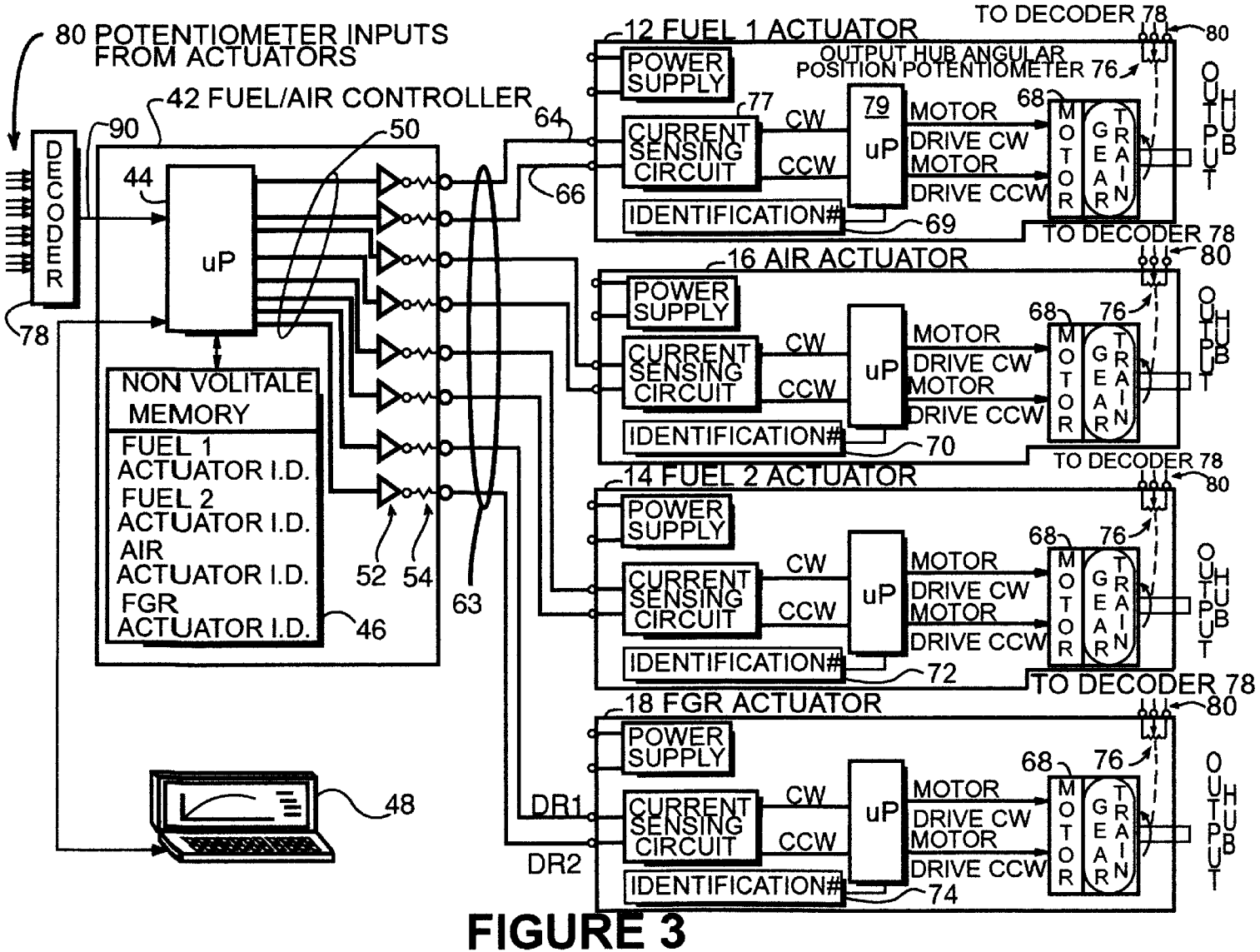
FIG. 3 is a schematic block diagram illustrating the components of the present invention.

FIG. 3 is a block diagram illustrating the components of the present invention. Fuel/air controller 43 includes a microprocessor 44 and a nonvolatile memory 46 that is coupled to the microprocessor 44. Computer 48 provides a communication link to microprocessor 44 to control the operation of microprocessor 44. Microprocessor 44 generates signals via connectors 50 that are coupled to driver circuits 52 and resistors 54. Two connectors, such as connectors 64 and 66, are connected to each actuator. Connector 64 provides a current signal to cause the actuator to rotate in a clockwise direction for the duration of the signal provided on connector 64. Similarly, connector 66 provides a current signal that will cause the actuator 12 to rotate in a counterclockwise direction for the duration of the signal provided on connector 66. These positioning commands are digital pulses that have varying lengths and modulate the actuator for positioning control. For example, if the motor device 68 of fuel 1 actuator 12 requires 30 seconds to travel its entire rotational distance, pulsewidths having a resolution of 25 milliseconds would allow the motor to be driven with an accuracy of 1200 discreet positions.

At the time of manufacture, each of the actuators 12, 14, 16 and 18 is assigned a unique 32 bit identification number that is stored in a programmable read-only memory (PROM), flash memory, or other nonvolatile memory device, such as illustrated by storage device 69 of fuel 1 actuator 12, storage device 70 of air actuator 16, storage device 72 of fuel 2 actuator 14 and storage device 74 of FGR actuator 18. At the time that the modulated burner combustion system is commissioned or configured, the configuration device 43 (FIG. 1) stores the identification numbers of each of the actuators in nonvolatile memory 46. These commissioned actuator identification numbers uniquely identify each of the actuators 12, 14, 16 and 18. The actuators are programmed so that they will not respond to any current input from the current sensing circuit, such as current sensing circuit 77 of fuel 1 actuator 12, unless a valid identification number has been supplied by the fuel/air controller 42. In other words, positioning commands will not be executed until the actuator has been unlocked with the identification number that corresponds to the identification number that is stored for that particular actuator. If power is lost or other reset conditions are detected by the actuator, the actuator will revert to a locked status. The identification number and other commands are transmitted to the microprocessor of the actuator, such as microprocessor 79 of fuel 1 actuator 12, via the connectors 64 and 66.

Since each of the actuators automatically goes into a locked position when they detect a reset condition, the actuators must be unlocked to operate after the reset condition has occurred. This effectively prevents a noncommissioned actuator from being introduced into the modulator burner combustion system without going through the commissioning process. When a new controller is introduced into the modulated burner combustion system illustrated in FIG. 3, it will be unable to unlock the actuators because the new fuel/air controller will not contain the actuator identification numbers in its nonvolatile memory. Hence, the modulator burner combustion system illustrated in FIG. 3 will be unable to operate with a replacement controller until the replacement controller has been commissioned with the system.

As also shown in FIG. 3, each of the actuators includes an output hub angular position potentiometers, such as output hub angular position potentiometer 76 of fuel 1 actuator 12. This potentiometer is mechanically coupled to the output hub of actuator 56 and provides a resistance signal that is detected by decoder 78.

Figure 4:
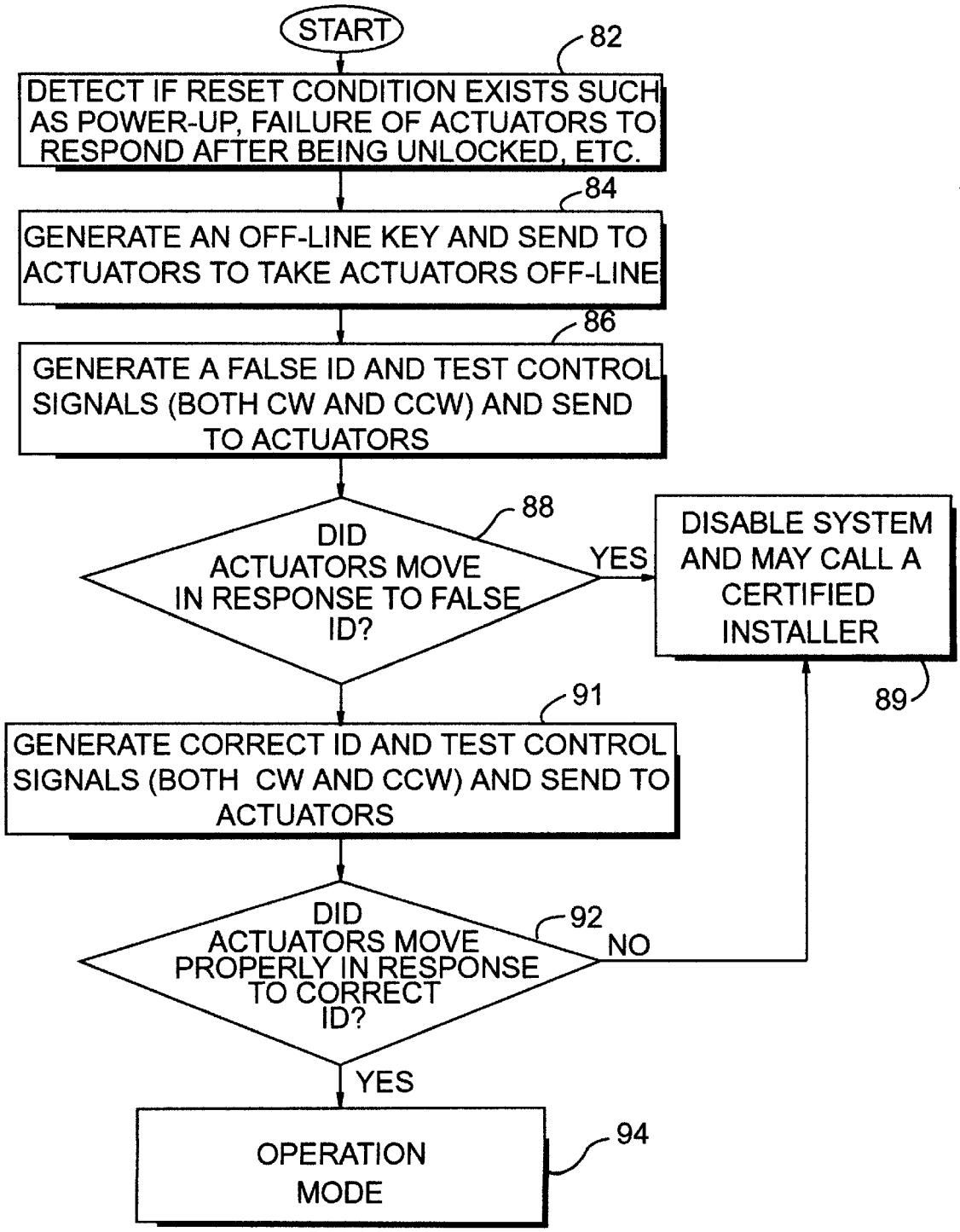
FIG. 4 is a flow diagram illustrating the operation of the microprocessor of the fuel/air controller illustrated in FIG. 3.
Figure 5:
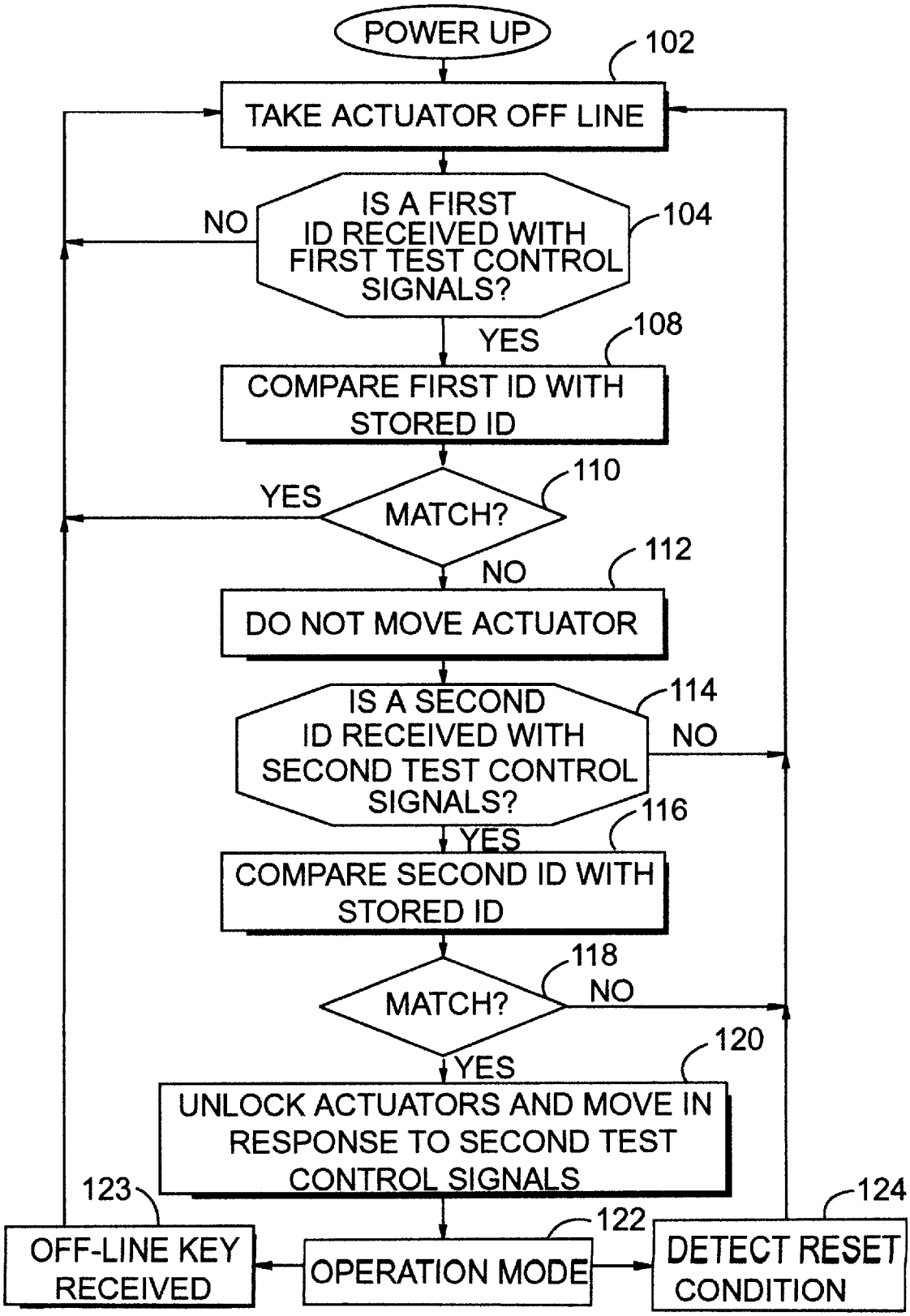
FIG. 5 is a flow diagram illustrating the operation of a microprocessor of a typical actuator illustrated in FIG. 3.

The operation of the system illustrated in FIG. 3 will become more apparent with respect to the description of FIGS. 4 and 5. FIG. 4 is a schematic flow diagram illustrating the functions performed by the microprocessor 44 of fuel/air controller 42. Initially, microprocessor 44 detects if a reset condition exists, such as the system being powered up, failure of the actuators to respond after being unlocked, or other reset conditions, as illustrated at step 82 of FIG. 4. At that point, the microprocessor 44 generates an off line key, which is an off line identification number, and transmits this off line identification number to the actuators to take the actuators off line at step 84. At step 86, microprocessor 44 generates a false ID, which is an ID that does not correspond to the IDs for the commissioned actuators 12, 14, 16 and 18. In other words, the false IDs are IDs that do not correspond to the IDs that are stored in the commissioned actuators at the time of manufacture. Test control signals are also sent at step 86 via connector 63 to the actuators 12, 14, 16 and 18. These test control signals are signals that cause the current sensing circuits, such as current sensing circuit 77, to instruct microprocessor 79 to drive the motor 68 in both a clockwise direction and a counterclockwise direction. In this manner, a failure to respond will not be the result of the fact that the motor is rotated completely in one direction.

Referring again to FIG. 4, at step 88, the microprocessor 44 (FIG. 3) determines if the actuators move in response to the false ID. As described above with regard to the description of FIG. 3, the output hub angular position potentiometer 76 provides a variable resistance when the output hub rotates, which is sensed by decoder 78 via connectors 80. The decoder 78 transmits a signal 90 to the microprocessor 44 indicating movement of the motor 68. Referring again to FIG. 4, if movement is detected at step 88, the microprocessor 44 disables the system and provides an indication that the system has been disabled. Alternatively, microprocessor 44 may generate a call to a certified installer. If the microprocessor 44 determines that the motor 68 did not respond to the false ID at step 88, a correct ID is generated at step 91, together with test control signals in both the clockwise and counterclockwise directions, and these signals are sent to the actuators via connectors 63. At step 92, microprocessor 44 determines if the actuators moved properly in response to the correct ID and test control signals. For example, microprocessor 44 will determine if the actuators moved at all, or if they moved the proper amount in response to the test control signals. If they did not move properly, or at all, microprocessor 44 will disable the system in the manner described above. Improper movement of the actuators indicates that the actuators are not working properly and should be replaced. If the actuators did move properly, the system will then go into an operation mode at step 94.

FIG. 5 is a schematic flow diagram of the operation of the actuator microprocessors, such as microprocessor 79 of actuator 12. The actuator is automatically taken off line at step 102 to prevent operation of the actuator until the actuator is unlocked. The microprocessor 79 then checks to see if a first identification number is received together with test control signal at step 104. If a first identification number is not received the actuator is taken off line at step 102. If the first identification number is received, microprocessor 79 compares the first ID with the stored ID for the actuator at step 108. At step 110, the microprocessor determines if there is a match between the first ID and the stored actuator ID. Since the first ID should be a false ID, a match between these IDs will cause the actuator to be taken off line at step 102. If there is no match, the first ID is indeed a false ID and the actuator is not moved in response to the test control signals at step 112. At step 114, the microprocessor 79 determines if a second ID is received with second test control signals. If a second ID is not received with the second test control signal, the actuator is taken off line at step 102. If the second ID is received with the second test control signals, the microprocessor 79 compares the second ID with the stored actuator ID at step 116. If the IDs do not match, the actuator is taken off line at step 102 since the second ID should correspond to the stored ID for the actuator. If there is a match, the actuators are unlocked and moved in response to the second test control signals at step 120. The actuators are then placed in an operational mode at step 122. If the actuators detect a reset condition at step 124, the actuators are taken off line in step 102. When an off line key is received pursuant to step 84 off FIG. 4 the actuators are also taken off line. The process then begins again at step 102.

The feedback system that is illustrated in FIGS. 3, 4 and 5, eliminates the need for any safety software to be included within the actuator microprocessor, such as actuator microprocessor 79. The fuel/air controller 42 uses a Class C approved operating system in microprocessor 44. The fuel/air controller 42 performs plausibility checks on the actuators that verify that the commands sent to the actuator to move the actuator in either a clockwise or counterclockwise direction are indeed carried out by the actuator in the proper manner. This verification is provided by the output hub angular position potentiometer 76 via decoder 78. As a result, expensive safety software does not have to be included within the actuator and the actuator can be implemented with an inexpensive processor.

The present invention therefore provides a system that is capable of preventing the replacement of components, such as a fuel/air controllers or actuators that were originally commissioned, or originally configured with the system. The present invention prevents the operation of the system if a proper ID is not provided by the controller to the actuator. To ensure that the system has not been tampered with or overridden in some fashion, false IDs are provided together with test control signals. If the system operates in response to false IDs, that is an indication that the system has been tampered with and the system is shut down. The system can also verify that the components are operating properly.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A modulated burner combustion system comprising:

an actuator that has an actuator identification number that identifies said actuator;

a position indicator coupled to said actuator that indicates movement of said actuator;

a controller that stores an actuator identification number corresponding to an actuator that has been configured with said modulated burner combustion system to provide a predetermined fuel/air ratio profile for said modulated burner combustion system and transmits said actuator identification number stored in said controller to said actuator together with test control signals, and disables said modulated burner combustion system if said position indicator indicates that said actuator has failed to move properly in response to said test control signals.

2. A modulated burner combustion system comprising:

actuator components that have actuator identification numbers that identify said actuator components;

position indicators that indicate movement of said actuator components;

a controller component that stores actuator identification numbers for actuator components that have been configured with said modulated burner combustion system to provide a predetermined fuel/air ratio profile and transmits to said actuator components said actuator identification numbers stored in said controller component, false actuator identification numbers that do not correspond to said actuator identification numbers stored in said controller component, together with test control signals to operate said actuator components and disables said modulated burner combustion system if said position indicators indicate movement of said actuator components in response to said false actuator identification numbers, and if said position indicators indicate that said actuator components have failed to move properly in response to said actuator identification numbers stored in said controller.

3. A modulated burner combustion system comprising:

actuator components that have actuator identification numbers that identify said actuator components;

a first controller component that stores actuator identification numbers for actuator components that have been configured with said modulated burner combustion system to provide a predetermined fuel/air ratio profile;

a second controller component that compares said actuator identification numbers stored in said first controller component with said actuator identification numbers that identify said actuator components and prevents the use of said actuator components if said actuator identification numbers stored in said first controller component do not match said actuator identification numbers that identify said actuator components.

4. A method of operating a modulated burner combustion system that includes a controller, at least one actuator, and at least one position indicator that have been configured to provide a predetermined fuel/air ratio profile for operating said modulated burner combustion system comprising the steps of:

transmitting an actuator identification numbers from said controller to said actuator with test control signals;

detecting if said position indicator indicates movement of said actuator in response to said test control signals;

preventing use of said modulated burner combustion system when movement is not detected by said position indicator following transmission of said test control signals and an actuator identification number that corresponds to an actuator in said modulated burner combustion system when said modulated burner combustion system was configured.

5. The method of claim 4 further comprising the step of:

preventing use of said modulated burner combustion system when movement is detected by said position indicator following transmission of said test control signals and an actuator identification number that does not correspond to an actuator in said modulated burner combustion system when said modulated burner combustion system was configured.

6. A method of preventing the use of noncommissioned components in a combustion system that uses a predetermined fuel/air profile that is generated using commissioned components that are used to generate said predetermined fuel/air profile when said combustion system is commissioned comprising the steps of:

determining if actuator identification numbers stored in a controller component match actuator identification numbers provided for each actuator component by detecting movement of said actuator components in response to first test control signals;

preventing operation of said combustion system if no movement of said actuator components is detected in response to said first test control signals.

7. The method of claim 6 further comprising the step of:

detecting movement of said actuator components in response to second test control signals whenever incorrect actuator numbers are provided to said actuators;

preventing operation of said combustion system whenever movement of said actuator components is detected in response to said second test control signals.

8. A method of operating a burner combustion system to prevent the use of components that are not commissioned with said burner combustion system comprising the steps of:

recording a fuel/air ratio profile for said burner combustion system using at least one actuator that has an actuator identification number;

storing said actuator identification number in a controller that controls said actuator;

transmitting said actuator identification number that is stored in said controller to said actuator together with test control signals;

comparing said actuator identification number that is transmitted to said actuator with said actuator identification number that is stored in said actuator;

preventing operation of said burner combustion system if said actuator identification number stored in said controller does not match with said actuator identification number stored in said actuator;

operating said actuator in response to said test control signals upon matching of said actuator identification number stored in said controller and said actuator identification number stored in said actuator;

detecting if said actuators have operated properly in response to said test control signals;

preventing operation of said burner combustion system if said actuators have not operated properly in response to said test control signals.

9. The method of claim 8 further comprising the step of:

generating an incorrect actuator identification number and transmitting said incorrect actuator identification number and test control signals to said actuator;

detecting if said actuator operates in response to said test control signal transmitted with said incorrect actuator identification number;

preventing operation of said burner combustion system if said actuator operates in response to said test control signal transmitted with said incorrect actuator signal.

10. A method of operating a modulated burner combustion system to prevent the use of components that have not been commissioned for use with said modulated burner combustion system comprising the steps of:

generating a false identification number in a controller component that does not match a correct actuator identification number associated with a commissioned actuator;

generating a first test control signal;

detecting movement of an actuator in response to said first test control signal;

disabling said combustion system upon detecting movement of said actuator.

11. A method of operating a modulated burner combustion system to prevent the use of components that have not been commissioned for use with said modulated burner combustion system comprising the steps of:

generating a first identification number in a controller component that does not match a correct actuator identification number associated with a commissioned actuator;

determining if said first identification number has been detected;

disabling said modulated burner combustion system if said first identification number is not detected.

12. A method of detecting the presence of a noncommissioned controller in a combustion system that includes at least one commissioned actuator comprising the steps of:

comparing actuator identification numbers stored in a controller included in said combustion system with at least one commissioned actuator identification number associated with said at least one commissioned actuator;

operating said at least one commissioned actuator located in said combustion system in response to a test control signal whenever said actuator identification numbers stored in said controller match said at least one commissioned actuator identification number associated with said at least one commissioned actuator;

detecting operation of said at least one commissioned actuator;

preventing operation of said combustion system if said at least one commissioned actuator fails to operate properly.

13. The method of claim 12 further comprising the step of:

transmitting said actuator identification numbers stored in said controller to said at least one commissioned actuator for comparison.

14. A method of detecting the presence of at least one noncommissioned actuator in a combustion system that has a predetermined fuel/air profile, said predetermined fuel/air profile being generated using a commissioned controller and commissioned actuators comprising the steps of:

comparing commissioned actuator identification numbers stored in said commissioned controller with actuator identification numbers associated with actuators located in said combustion system;

operating said actuators located in said combustion system in response to a test control signal whenever said commissioned actuator identification numbers match said actuator identification numbers associated with said actuators located in said combustion system;

preventing operation of said combustion system whenever any of said actuators located in said combustion system fail to operate properly.

15. The method of claim 14 further comprising the step of:

transmitting said commissioned actuator numbers stored in said commissioned controller to said actuators for comparison.

* * * * *